US011828554B2

(12) United States Patent
Christiansen

(10) Patent No.: US 11,828,554 B2
(45) **Date of Patent: *Nov. 28, 2023**

(54) FIREARM SAFETY FEATURE

(71) Applicant: Ned Forrest Christiansen, Three Rivers, MI (US)

(72) Inventor: Ned Forrest Christiansen, Three Rivers, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/571,384

(22) Filed: Jan. 7, 2022

(65) Prior Publication Data

US 2022/0214125 A1 Jul. 7, 2022

Related U.S. Application Data

(63) Continuation of application No. 16/821,209, filed on Mar. 17, 2020, now Pat. No. 11,255,622, which is a continuation of application No. 15/221,220, filed on Jul. 27, 2016, now Pat. No. 10,648,755.

(60) Provisional application No. 62/197,937, filed on Jul. 28, 2015.

(51) Int. Cl.
*F41A 17/56* (2006.01)
*F41A 17/22* (2006.01)

(52) U.S. Cl.
CPC ..... *F41A 17/56* (2013.01); *F41A 17/22* (2013.01)

(58) Field of Classification Search
CPC ..... F41A 17/22; F41A 17/56
USPC ..... 42/70.05
See application file for complete search history.

(56) References Cited

U.S. PATENT DOCUMENTS

| | | | | | |
|---|---|---|---|---|---|
| 2,388,443 | A * | 11/1945 | Ruger | F41A 19/46 | 89/142 |
| 4,275,640 | A * | 6/1981 | Wilhelm | F41A 19/48 | 89/147 |
| 4,555,861 | A * | 12/1985 | Khoury | F41A 17/72 | 42/70.08 |
| 10,648,755 | B1 * | 5/2020 | Christiansen | F41A 17/56 | |
| 11,255,622 | B2 * | 2/2022 | Christiansen | F41A 17/56 | |
| 2016/0153732 | A1 * | 6/2016 | Geissele | B23H 9/00 | 42/69.01 |

* cited by examiner

*Primary Examiner* — Bret Hayes
(74) *Attorney, Agent, or Firm* — Larry E. Henneman, Jr.; Henneman & Associates, PLC

(57) ABSTRACT

A novel firearm safety feature includes arresting surfaces for preventing the fall of a hammer in the event of a spontaneous failure of other firearm parts. In a particular embodiment a safety lug has an arresting surface and the hammer has a complementary arresting surface. In the event of a spontaneous failure, the arresting surface and the complementary arresting surface create a positive engagement and prevent the hammer from falling. In another embodiment, a grip safety includes an arresting surface and the hammer includes a complementary arresting surface. In the event of a spontaneous failure, the arresting surface and the complementary arresting surface create a positive engagement and prevent the hammer from falling.

11 Claims, 11 Drawing Sheets

Unloaded and unlocked. Rear of barrel tilted down by barrel link, slide held open by slide stop.

FIREARM SAFETY FEATURE

RELATED APPLICATIONS

This application is a continuation of co-pending U.S. application Ser. No. 16/821,209, filed on Mar. 17, 2020 by the same inventor, which is a continuation of U.S. application Ser. No. 15/221,220, filed on Jul. 27, 2016 by the same inventor, which claims the benefit of priority to U.S. Provisional Patent Application No. 62/197,937, filed Jul. 28, 2015 by the same inventor and entitled "Firearm Safety Feature", all of which are incorporated herein by reference in their respective entireties.

BACKGROUND OF THE INVENTION

Field of the Invention

This invention relates generally to firearms, and more particularly to safety features for firearms.

Description of the Background Art

Firearms are utilized for many applications including, but not limited to, hunting, target shooting, and home-defense. Firearms are designed to fire a projectile at a high rate of speed and are, therefore, very dangerous. Thus, safety is a primary concern when manufacturing and using firearms. A safety is a mechanical device that prevents unintended discharge of the firearm. Prior art safeties depend on other parts of the firearm in order to function properly. If one of these parts is broken, the safety will not function properly and the firearm may fire unintentionally.

For example, the US M1911 pistol is typically carried with the hammer cocked and the safety on. Carrying it in this manner has proven over the last 100+ years to be relatively safe, however, any mechanical device can fail due to spontaneous failure or improper assembly.

SUMMARY

The present invention provides safeguards, in addition to the traditional thumb safety, against the pistol firing unintentionally in the event of spontaneous part(s) failure due to, for example, an unintended impact upon the hammer or other part(s). It also increases safety in the event of improper assembly of the pistol, which could cause the sear pin to come out to the right side of the pistol, causing the sear to fail at holding the hammer in the cocked position.

An example firearm safety feature includes a firing pin, a hammer operative to impact the firing pin, a sear operative to engage the hammer such that the hammer is prevented from impacting the firing pin, a trigger operative to disengage the sear from the hammer, allowing the hammer to impact the firing pin, a safety switchable between a safe position and a firing position. The hammer includes an arresting surface and a portion of the safety positioned to prevent the sear from disengaging the hammer when the trigger is depressed includes a complementary arresting surface. The arresting surface and the complementary arresting surface become positively engaged when the safety is engaged and the sear fails to engage the hammer. In a more particular embodiment the arresting surface is defined by a first angled cut in the hammer and the complementary arresting surface is defined by a second angled cut in the portion of the safety. The first angled cut and the second angled cut are equiangular.

Another example firearm safety feature includes a firing pin, a hammer operative to impact the firing pin, a sear operative to engage the hammer such the hammer is prevented from impacting the firing pin, a trigger operative to engage the sear such that when the trigger is depressed the sear disengages from the hammer to allow the hammer to impact the firing pin, and a grip safety preventing the trigger from engaging the sear absent a firing grip on the firearm. The hammer includes an arresting surface and the grip safety includes a complementary arresting surface adjacent the hammer when the hammer is in a cocked position. The arresting surface and the complementary arresting surface become positively engaged when the grip safety is in a safe position and the sear fails to engage the hammer. In a particular embodiment, the hammer defines a travel path before impacting said firing pin, and the travel path passes through the complementary arresting surface when the grip safety is in a safe position. The arresting surface and the complementary arresting surface are parallel when the hammer contacts the grip safety along the travel path.

BRIEF DESCRIPTION OF THE DRAWINGS

The present invention is described with reference to the following drawings, wherein like reference numbers denote substantially similar elements.

DETAILED DESCRIPTION

Figure 1:
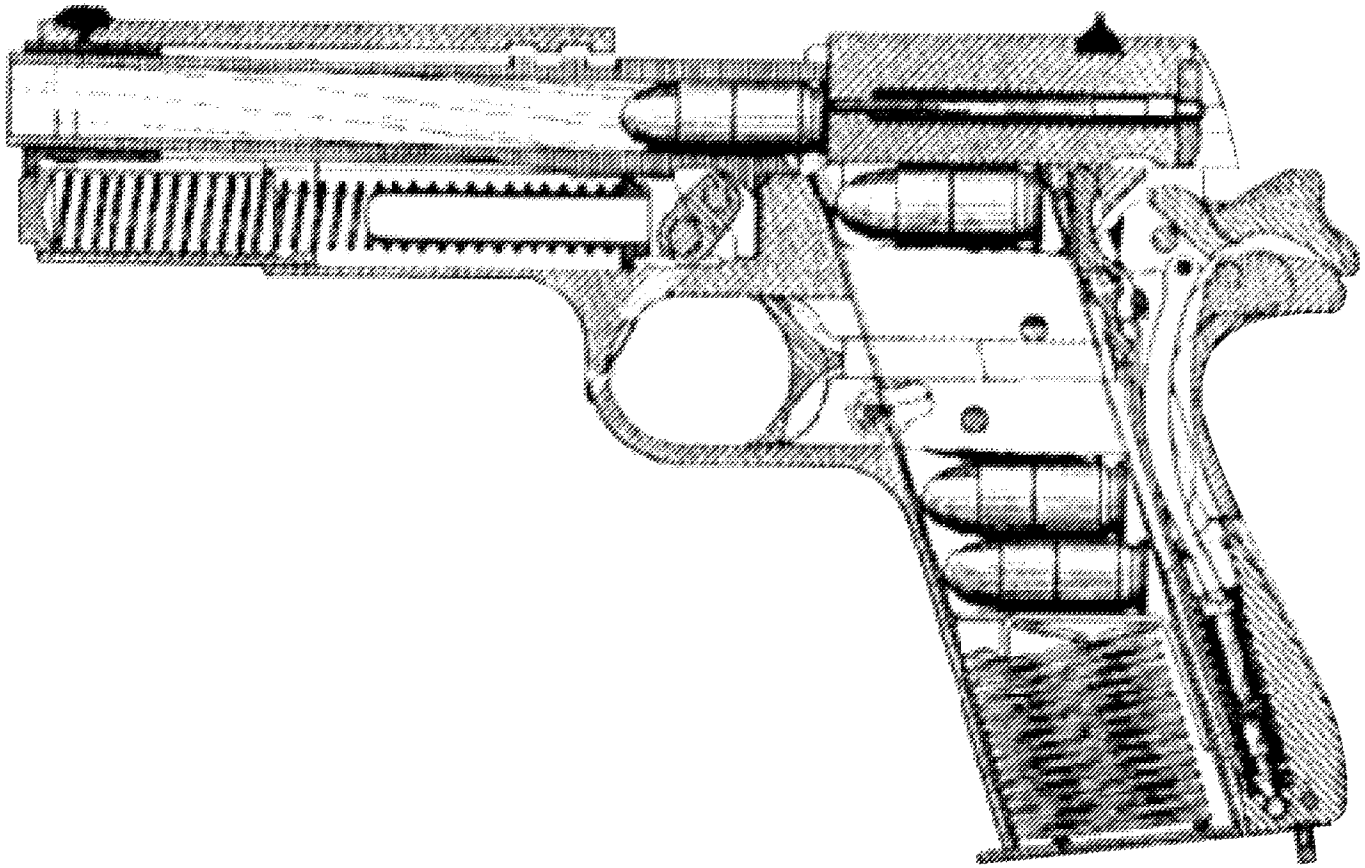
FIG. 1 (Prior Art)
FIG. 1 is a cutaway drawing of an example prior art firearm.

FIG. 1 is a cutaway drawing of an example firearm 100. Firearm 100 is a typical handgun, particularly a US M1911 pistol. While the M1911 pistol is used as an example, the present invention is not limited only to pistols of this type. Indeed, the designs can be adapted for use in any applicable firearm.

Figure 2:
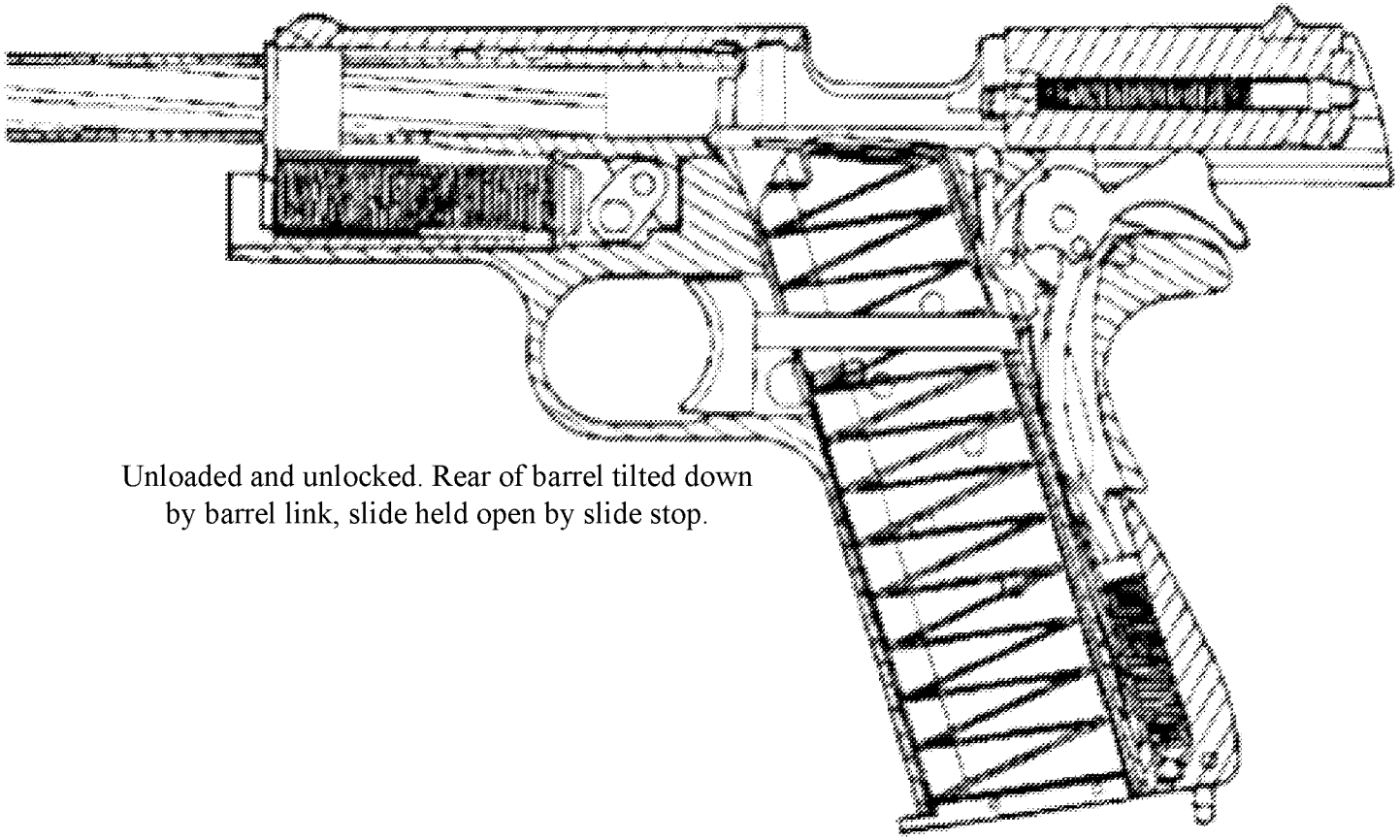
FIG. 2 (Prior Art)
FIG. 2 is cutaway drawing of the firearm of FIG. 1.

FIG. 2 is a cutaway drawing of firearm 100 in an alternate configuration, particularly in an unloaded and unlocked condition with the slide held open.

Figure 3:
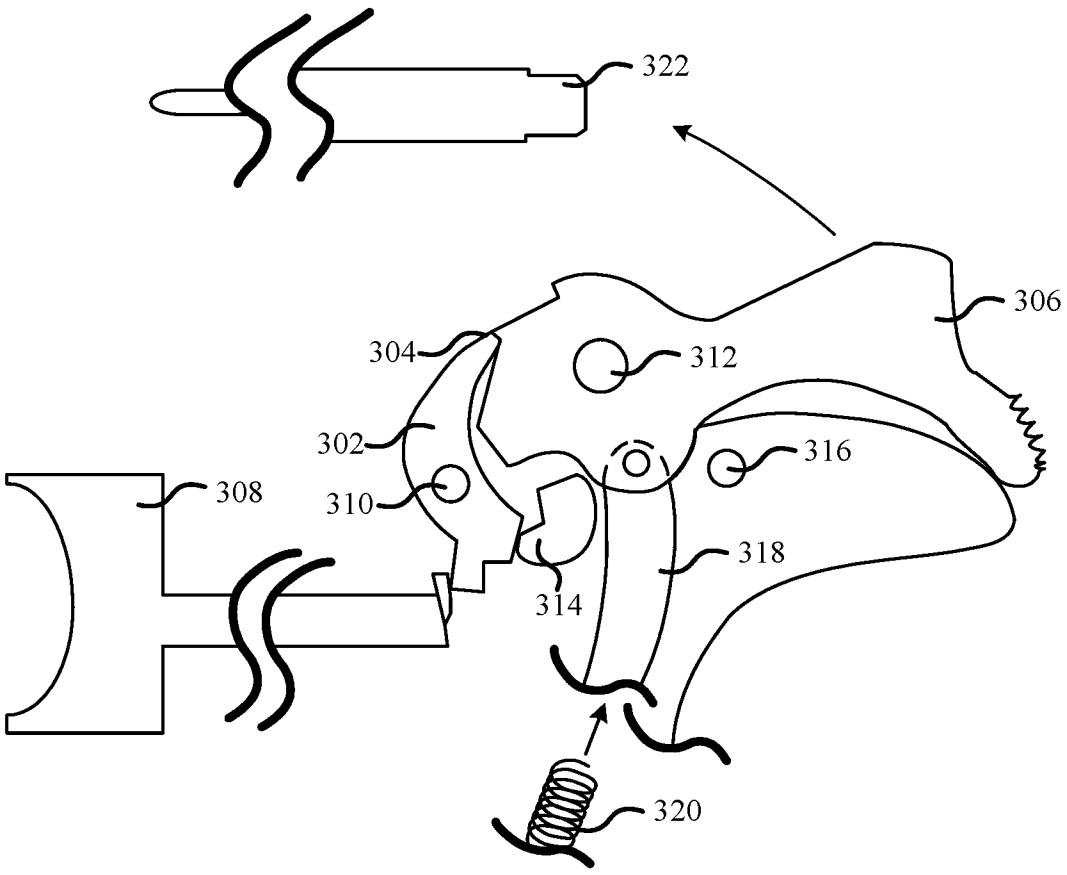
FIG. 3 (Prior Art)
FIG. 3 is a diagram showing various parts of the firing mechanism and thumb safety of the firearm of FIG. 1.

FIG. 3 is a diagram showing various parts of the firing mechanism and thumb safety of firearm 100. Applying the safety blocks a sear 302. When pulling a trigger 308 on the 1911, trigger 308 acts upon the bottom of sear 302, causing the bottom of sear 302 to move rearward. As sear 302 is mounted via a pivot pin 310 that is roughly vertically central to its body, when the bottom of sear 302 moves rearward, the top of sear 302 moves forward, disengaging from a sear notch 304 in a hammer 306, allowing hammer 306 to fall and contact a firing pin 322, which then impacts the cartridge and causes the cartridge to fire. When pulling trigger 308 with the safety on, the bottom of sear 302 is blocked from any rearward movement by a lug 314 integral to the safety, so the pistol will not fire.

Note that when the safety is engaged, it pivots or swings up, presenting integral lug 314 that protrudes inward, which blocks sear 302 as described above. This safety can only be engaged when hammer 306 is cocked. Hammer 306, pivoting on its own pin 312, comprises an upper portion, containing the part that actually contacts firing pin 322 and has serrations to increase friction for thumb-cocking, and the lower portion, which contains sear notch 304, which, in concert with the tip of sear 302, acts to hold hammer 306 in the cocked position. The safety can only be engaged with hammer 306 in a cocked position, because, in the cocked position, a radial clearance cut in the bottom portion of hammer 306 provides space for safety lug 314 to occupy when the safety is pivoted up into the "safe" position. In this "safe" position, lug 314 does appear to be in the way of hammer 306 falling, should a spontaneous failure of sear 302, sear pin 310, or sear notch 304 of hammer 306 occur. However, the relationship between cocked hammer 306 and safety lug 314 is such that if hammer 306 should fall, it will simply cam safety lug 314 out of the way and continue to fall onto firing pin 322. The safety's "on" and "off" positions are detented by a spring plunger, and the effort to move the safety up and down varies greatly from pistol to pistol and can be tuned to be heavy or light. In a pistol with heavy detents, this detent action, making downward movement of the safety require greater effort, could constitute enough resistance to the safety's movement to retard the fall of hammer 306 enough to prevent firing. However, in many pistols it will not, and, in any event, the safety detent effort is not and should not be relied upon as a safety feature.

Figure 4:
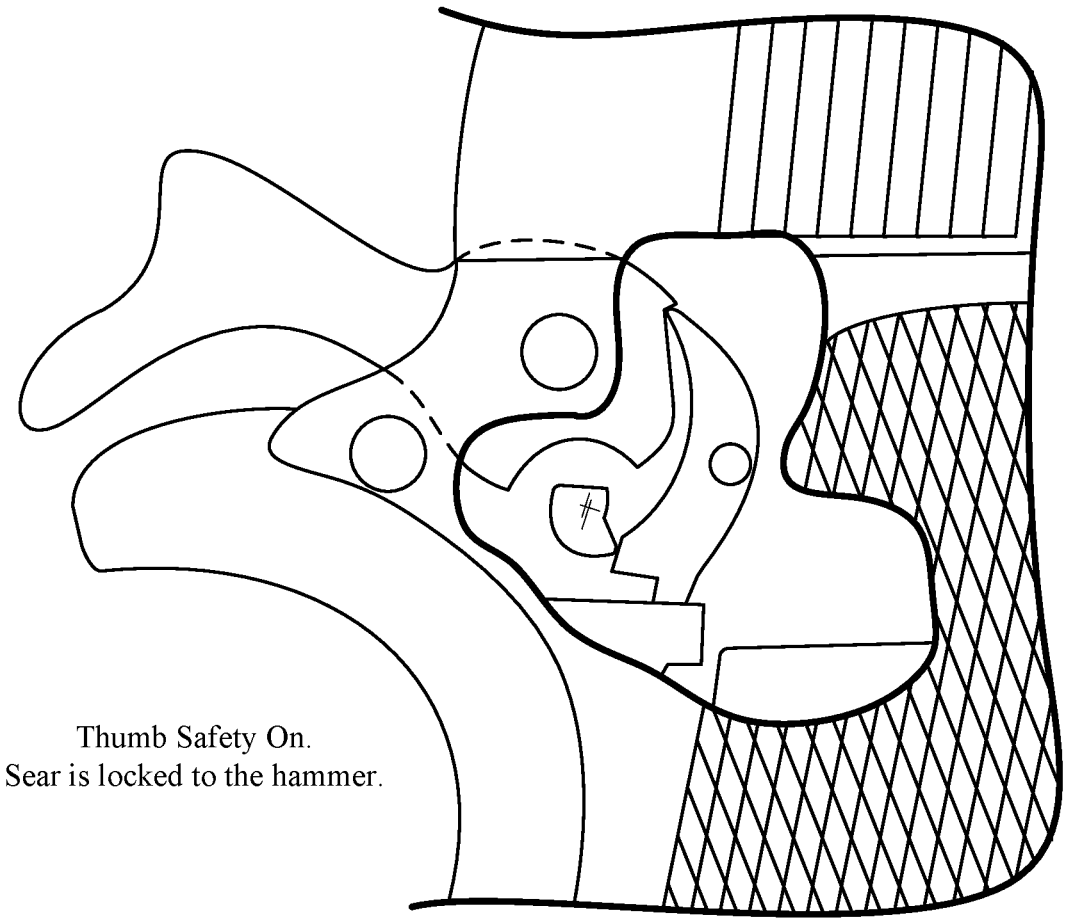
FIG. 4 (Prior Art)
FIG. 4 is a photograph of an example prior art cutaway firearm showing the thumb safety in an engaged configuration.

FIG. 4 is a photograph of an example prior art cutaway firearm 400 showing the thumb safety in an engaged configuration.

Figure 5:
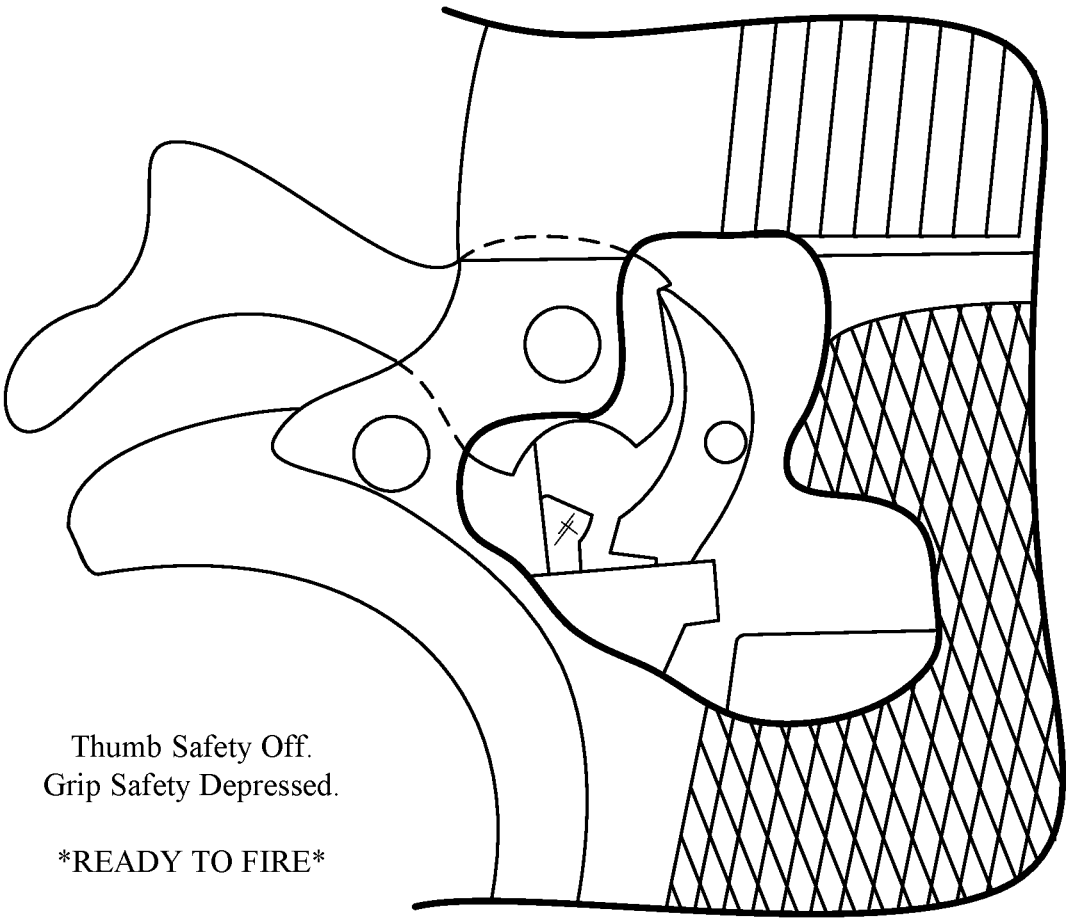
FIG. 5 (Prior Art)
FIG. 5 is a photograph of the firearm of FIG. 4 showing the thumb safety in an unengaged configuration.

FIG. 5 is a photograph of firearm 400 showing the thumb safety in an unengaged configuration.

Figure 6A:
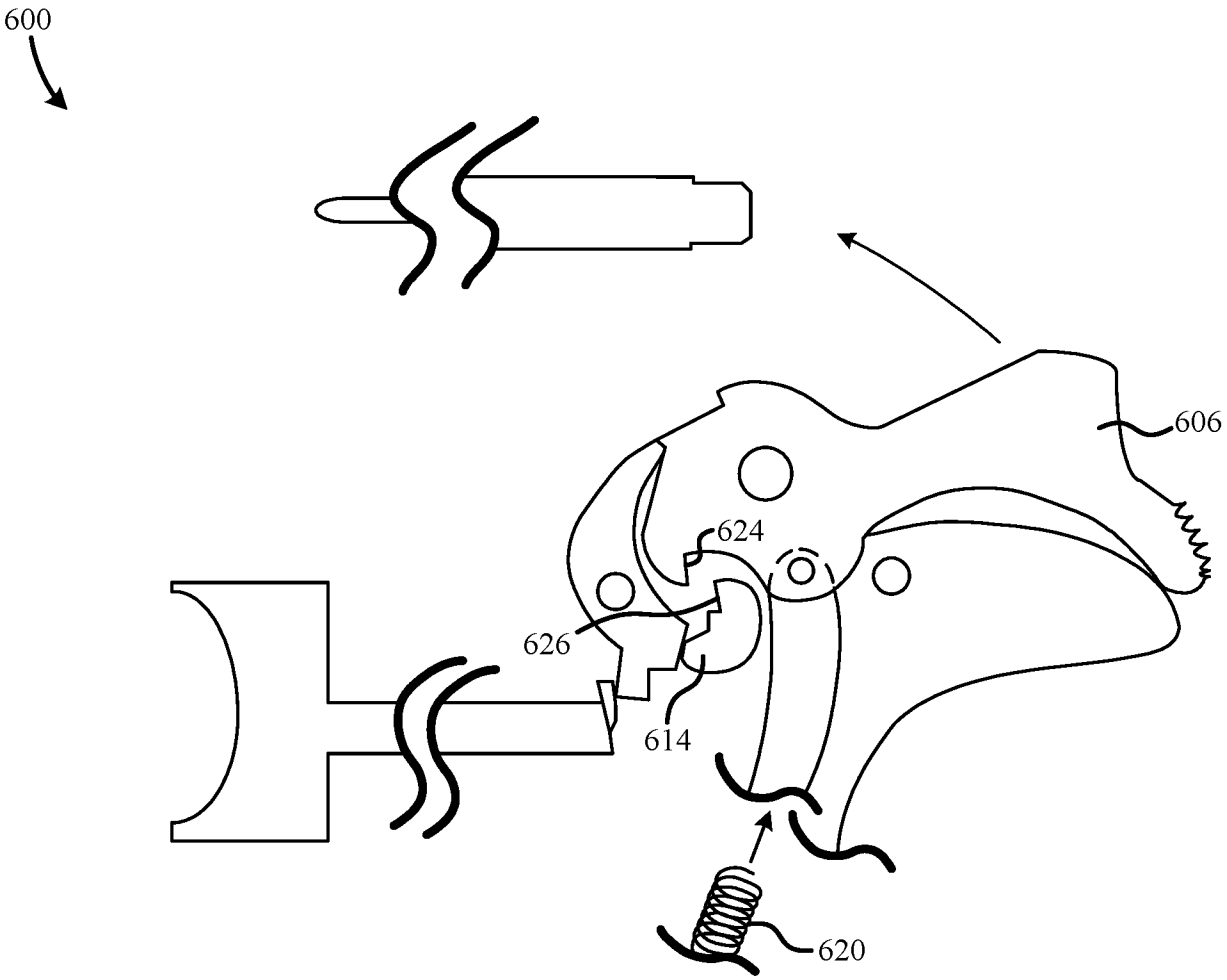
FIG. 6A is a diagram showing various parts of an example firearm including a thumb safety according to the present invention.

FIG. 6A is a diagram showing various parts of an example firearm 600 including a thumb safety according to the present invention. The present invention includes alterations to the previously discussed safety system. Particularly, it includes differently shaped hammer 606 and safety lug 614. Even more particularly, hammer 606 includes an arresting surface 624 and safety lug 614 includes a complementary arresting surface 626. When contacting each other, these arresting surfaces create a positive engagement, preventing hammer 606 from falling.

In a traditional M1911, such as firearm 100, when the safety is engaged, it rotates upward and, subsequently, the safety lug rotates upward as well. When the hammer falls due to a failure of the sear, sear pin, or sear notch of the hammer, the hammer applies a rotational force on the safety lug, which rotates downward, and the safety disengages.

The present design prevents this by orienting the arresting surfaces in a way that eliminates the rotational force on safety lug 614. When the arresting surfaces come into contact, the resulting force on safety lug 614 is predominately radial, as opposed to tangential or rotational. Indeed, the rotation of hammer 606 acts to lift safety lug 614 toward hammer 606 as opposed to rotating it down and out of place. While a particular embodiment of the present invention is detailed below, it should be noted that alternate features can be used without departing from the scope of the present invention.

In the example design the radial cut in the bottom of hammer 606, provided to give safety lug 614 clearance, includes a right-angle cut or notch defined partially by arresting surface 624. Safety lug 614 also includes a right-angle cut defined partially by complementary arresting surface 626, so, should hammer 606 fall with the safety on, it is not possible for hammer 606 to simply bump or cam the safety to the off position and continue falling. Indeed, the hammer 606 and safety lug 614 will become hooked together, and due to the positive angles of the engagement surfaces, this engagement is very secure. Optionally, the engaging surfaces can be textured, coated, and/or otherwise adapted to increase the coefficient of friction between the surfaces, which makes the engagement even more secure. Under the influence of a hammer spring 620 on hammer 606, pushing it forward, hammer 606 and safety lug 614 tend to pull themselves into this positive engagement. This positive arresting of the fall of hammer 606 occurs about a third to half-way between the "cocked" and fully-forward positions of hammer 606.

Figure 6B:
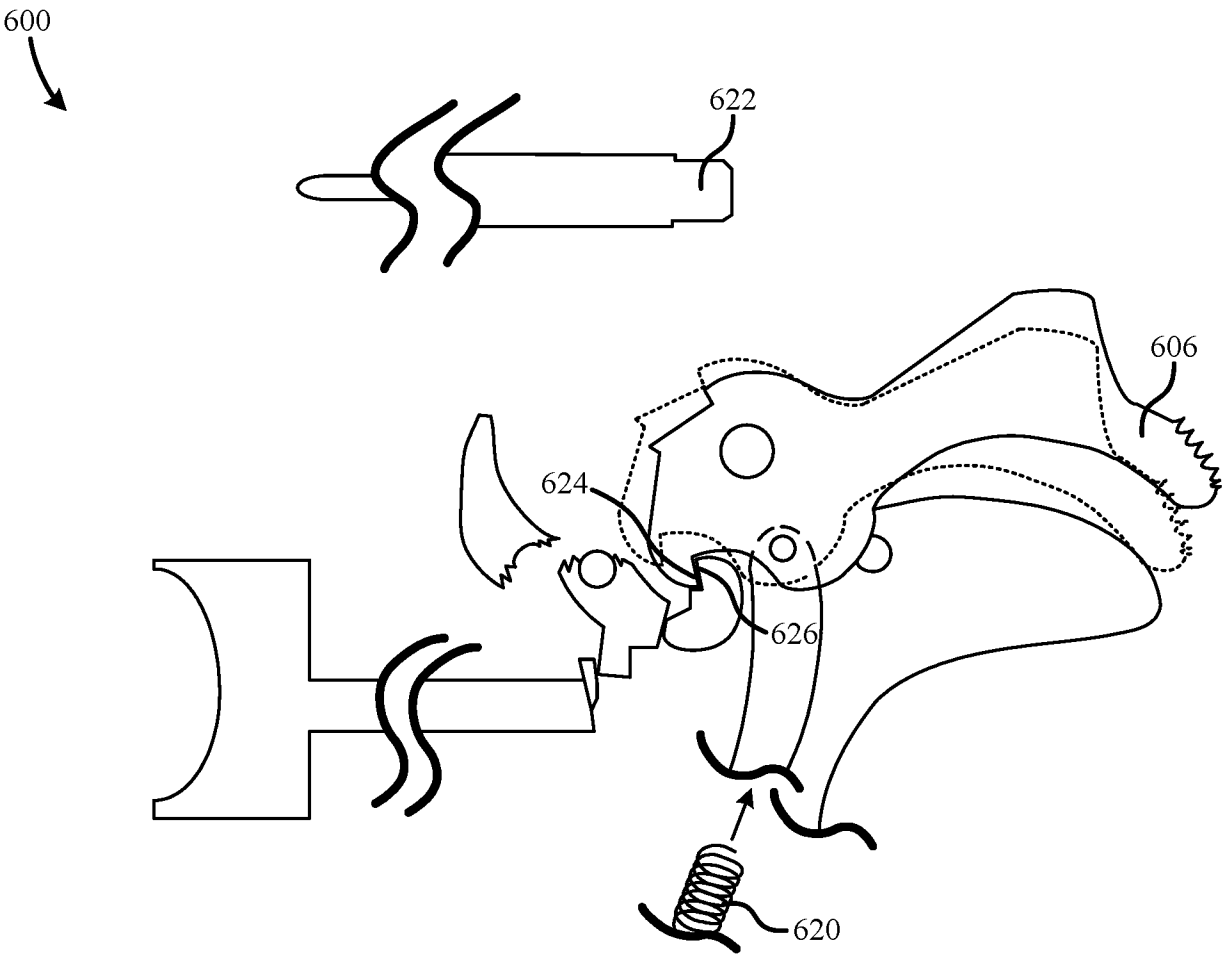
FIG. 6B is a diagram showing various parts of the firearm of FIG. 6A after failure of a sear.

FIG. 6B is a diagram showing various parts of the firearm of FIG. 6A after failure of a sear. Arresting surface 624 and complementary arresting surface 626 are positively engaged, preventing hammer 606 from falling and striking a firing pin 622.

Figure 7A:
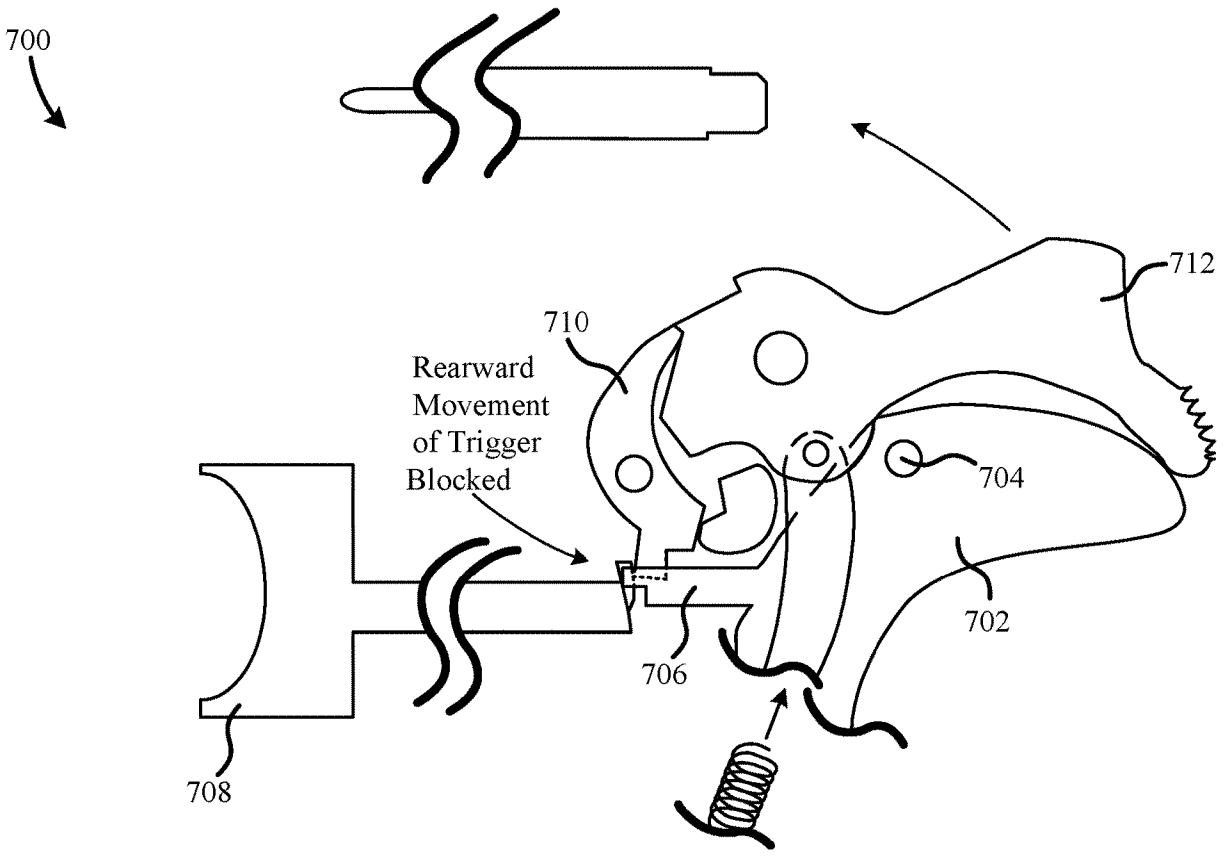
FIG. 7A (Prior Art)
FIG. 7A is a diagram showing various parts of an example firearm including a grip safety according to the prior art in an engaged configuration.

FIG. 7A is a diagram showing various parts of an example firearm 700 including a grip safety according to the prior art in an engaged configuration. Absent a firing grasp on the pistol, a grip safety 702, under the influence of a flat spring (not shown) inside the pistol's handle portion, pivots to the rear (about a pivot shaft 704 of the thumb safety). When pivoted to this position, a horizontal, forward-reaching arm 706 integral to the grip safety is pivoted downward and blocks the rearward movement of a trigger 708. While grip safety 702 prevents rearward movement of the trigger from disengaging a sear 710 from a hammer 712, and, thus, prevents unintended firing of firearm, someone skilled in the art will realize that grip safety 702 will not prevent unintended firing in the event of a failure of sear 710.

Figure 7B:
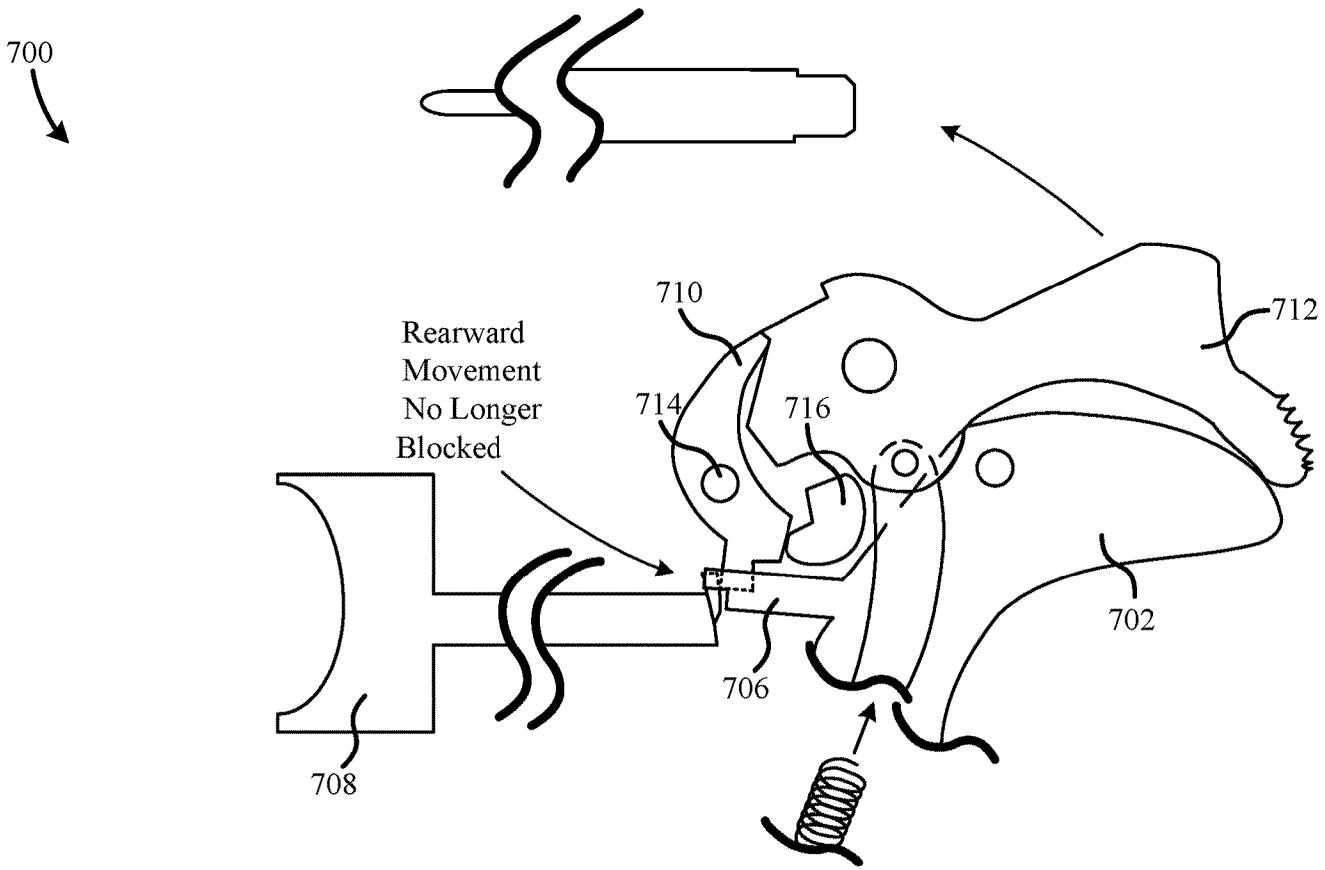
FIG. 7B (Prior Art)
FIG. 7B is a diagram showing the firearm of FIG. 7A showing the grip safety in an unengaged configuration.

FIG. 7B is a diagram showing the firearm of FIG. 7A showing the grip safety in an unengaged configuration. When a firing grasp is applied to the handle of firearm 700, grip safety 702 pivots forward, and forward reaching arm 706 is raised up and out of the path of trigger 708. In this position, trigger 708 can move rearward, rotating sear 710 about a sear pin 714 (assuming a safety lug 716 is in the firing position), thereby causing the pistol to fire. There is nothing about grip safety 702 that acts upon hammer 712 or blocks its path in any way.

Figure 8A:
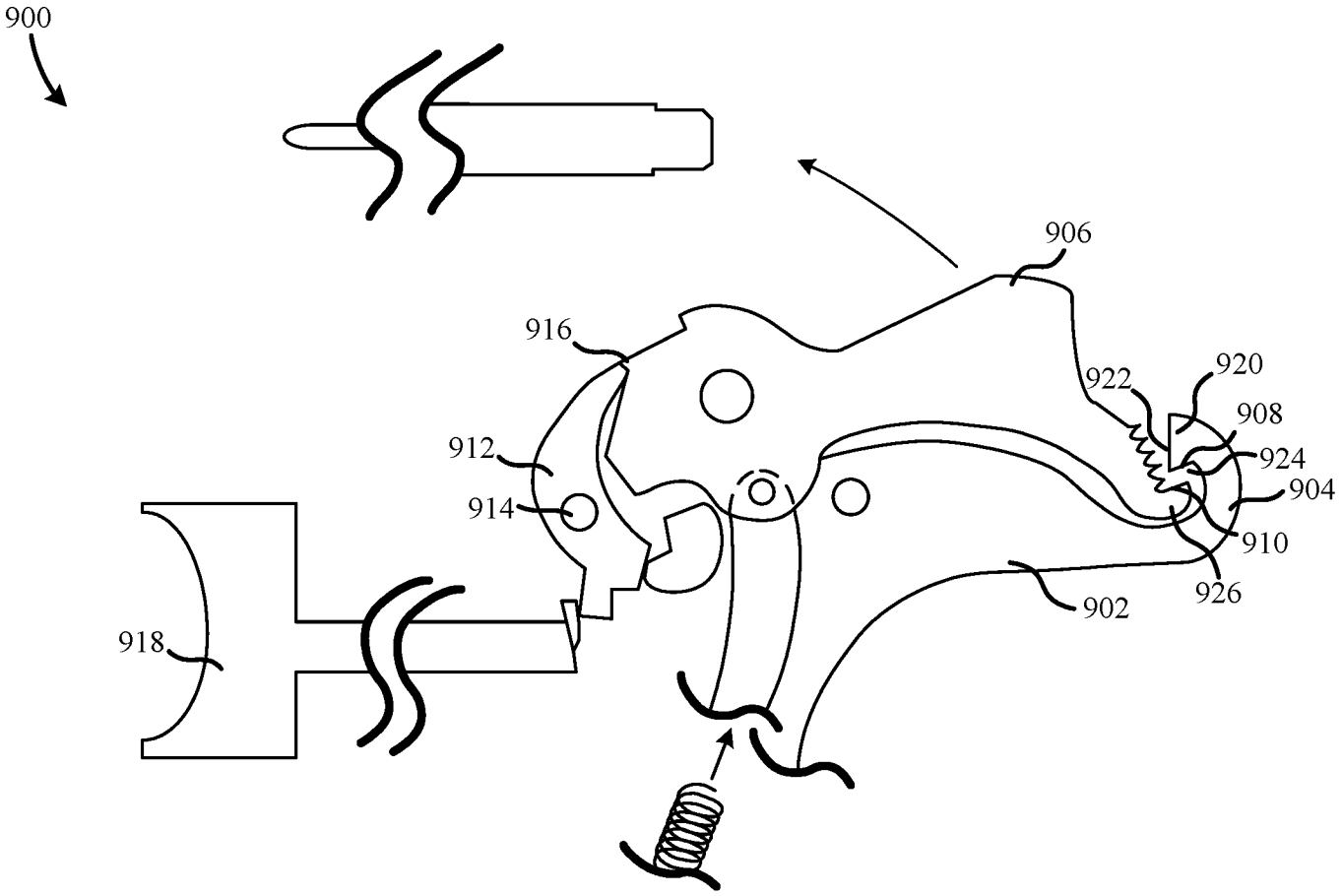
FIG. 8A is a diagram showing various parts of an example firearm including a grip safety according to the present invention in an engaged configuration.

FIG. 8A is a diagram showing various parts of an example firearm 900 including a grip safety 902 according to the present invention in an engaged configuration. Grip safety 902 includes alterations from the traditional grip safety. Particularly grip safety 902 includes a hook 904, which introduces a relationship between grip safety 902 and a hammer 906. In the example embodiment, hook 904 is fashioned into the "beavertail type". In alternate embodiments hook 904 can be altered or substituted for specific applications. Hook 904 includes an arresting surface 908, and hammer 906 includes a complementary arresting surface 910. When these surfaces contact each other, they create a positive engagement, preventing hammer 906 from falling.

The positive engagement arrests the forward movement of hammer 906 in the event of a spontaneous failure of a sear 912, a sear pin 914, or a sear notch 916 of hammer 906.

Absent a firing grasp on firearm 900, as stated above, a forward-protruding horizontal arm (not shown) of grip safety 902 blocks movement of a trigger 918. In the example design, grip safety 902 has an added portion 920 that presents a roughly vertical surface 922 behind cocked hammer 906. This added portion envelops hammer 906 at its rear, and vertical surface 922 has a horizontal cut 924 in it. Hammer 906 includes a raised hook 926 at the very rear of the "spur" or serrated thumb-cocking surface. When grip safety 902 is at rest in its "out" or "engaged" position, that is, when there is nothing pushing it inward, not only is trigger 918 blocked as per the original design, but the newly introduced rear vertical surface 922 with horizontal cut 924, in this at-rest position, is pivoted slightly upward and forward, so that raised hook 926, at the rear of the spur of hammer 906, is in an interference relationship with horizontal cut 924 in vertical surface 922. In other words, the arc described by raised hook 926, in the event of hammer 906 falling due to a spontaneous failure of sear 912, sear pin 914, or sear notch 916 on hammer 906, interferes with horizontal cut 924 in vertical surface 922 of grip safety 902, effecting a positive engagement of the two parts. This engagement positively arrests the forward fall of hammer 906, preventing an unintentional discharge.

Example grip safety 902, in that it by necessity envelops hammer 906 more than previous designs, also affords hammer 906 more protection against an unintentional blow, which could cause the engagement between hammer 906 and sear 912 to fail. Further, as it closes the gap that is normally present between a typical hammer and grip safety, the likelihood of getting an article of clothing snagged in the gap, interfering with the drawing of the pistol, is greatly reduced.

Figure 8B:
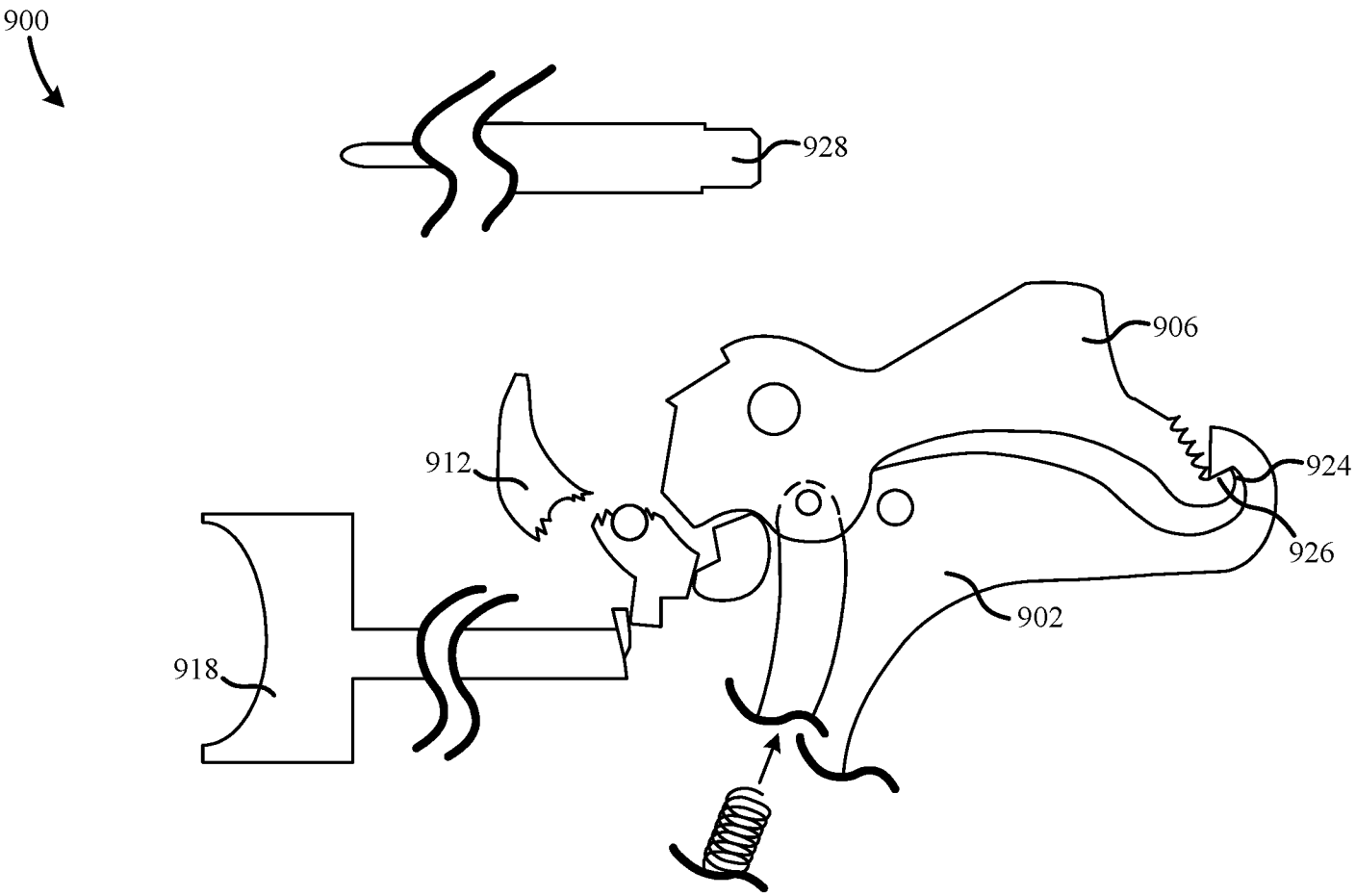
FIG. 8B is a diagram showing various parts of the firearm of FIG. 8A after failure of a sear.

FIG. 8B is a diagram showing various parts of the firearm of FIG. 8A after failure of a sear. Horizontal cut 924 and raised hook 926 are positively engaged, preventing hammer 906 from falling and striking a firing pin 928.

I claim:

1. A firearm safety feature, comprising:

a firing pin;

a hammer pivotably mounted and biased to rotate in a first direction between a cocked position and a second position wherein said hammer is operative to impact said firing pin, said hammer including an arresting surface;

a sear operative to engage said hammer such that said hammer is prevented from rotating in said first direction impacting said firing pin;

a trigger operative to disengage said sear from said hammer, allowing said hammer to rotate in said first direction and impact said firing pin;

a safety pivotably mounted to rotate between a safe position and a firing position, a portion of said safety positioned to prevent said sear from disengaging said hammer when said trigger is depressed; and wherein said portion of said safety includes a complementary arresting surface, and when said safety is in said safe position and said hammer rotates in said first direction toward said second position said arresting surface engages said complementary arresting surface in a manner that directs a force exerted on said safety by said hammer in a predominately radial direction.

2. The firearm safety feature of claim 1, wherein:

said arresting surface is defined by a first angled cut in said hammer;

said complementary arresting surface is defined by a second angled cut in said portion of said safety; and said first angled cut and said second angled cut are equiangular.

3. The firearm safety feature of claim 1, further comprising:

a grip safety configured to prevent said trigger from engaging said sear absent a firing grip on said firearm and comprising a second complementary arresting surface adjacent a distal end of said hammer when said hammer is in a cocked position; and wherein said hammer includes a second arresting surface at said distal end of said hammer; and said second arresting surface and said second complementary arresting surface become positively engaged when said grip safety is in a safe position and said hammer rotates from said cocked position in said first direction.

4. The firearm safety feature of claim 1, wherein said engagement of said arresting surface and said complementary arresting surface prevents said safety from being knocked out of said safe position by said hammer.

5. The firearm safety feature of claim 1, wherein at least one of said arresting surface and said complementary arresting surface are textured.

6. The firearm safety feature of claim 1, wherein at least one of said arresting surface and said complementary arresting surface includes a friction enhancing coating.

7. The firearm safety feature of claim 1, wherein via said engagement of said arresting surface and said complementary arresting surface said hammer biases said safety into said safe position.

8. A firearm safety feature, comprising:

a firing pin;

a hammer pivotably mounted and biased to rotate in a first direction between a cocked position and a second position wherein said hammer is operative to impact said firing pin, said hammer including an arresting surface;

a sear operative to engage said hammer such that said hammer is prevented from rotating in said first direction;

a trigger operative to engage said sear such that when said trigger is depressed said sear disengages from said hammer, allowing said hammer to rotate in said first direction and impact said firing pin;

a grip safety configured to prevent said trigger from engaging said sear absent a firing grip on said firearm and comprising a complementary arresting surface adjacent a distal end of said hammer when said hammer is in a cocked position; and wherein said arresting surface and said complementary arresting surface become positively engaged when said grip safety is in a safe position and said hammer rotates from said cocked position in said first direction.

9. The firearm safety feature of claim 8, wherein:

said arresting surface of said hammer defines a travel path between said cocked position and said second position; and said travel path passes through said complementary arresting surface when said grip safety is in a safe position; and said travel path does not pass through said complementary arresting surface when said grip safety is in an unsafe position.

10. The firearm safety feature of claim 8, wherein:

said grip safety is pivotably mounted to rotate about an axis between a safe position and a firing position;

said grip safety includes a grip portion extending downwardly from said axis;

said grip safety includes a hammer engaging portion extending upwardly from said axis;

said grip safety additionally includes a biasing member disposed to exert a force on said grip safety urging said grip safety into said safe position; and a firing grip on said firearm overcomes said force exerted by said biasing member and moves said grip portion toward said firearm and moves said hammer engaging portion away from said hammer.

11. The firearm safety feature of claim 10, wherein said hammer engaging surface of said grip safety includes a hook disposed at least partially around said distal end of said hammer.

* * * * *